US008774689B2

(12) United States Patent
Shida

(10) Patent No.: US 8,774,689 B2
(45) Date of Patent: Jul. 8, 2014

(54) ELECTROPHOTOGRAPHIC IMAGE FORMING APPARATUS

(75) Inventor: Masanori Shida, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 227 days.

(21) Appl. No.: 13/274,187

(22) Filed: Oct. 14, 2011

(65) Prior Publication Data

US 2012/0093545 A1 Apr. 19, 2012

(30) Foreign Application Priority Data

Oct. 19, 2010 (JP) ..... 2010-234229

(51) Int. Cl.
*G03G 15/16* (2006.01)

(52) U.S. Cl.
USPC ..... 399/312

(58) Field of Classification Search
USPC ..... 399/312
See application file for complete search history.

(56) References Cited

U.S. PATENT DOCUMENTS

| | | | | |
|---|---|---|---|---|
| 8,219,001 | B2 * | 7/2012 | Sendo et al. | 399/121 |
| 2011/0110692 | A1 * | 5/2011 | Ideguchi | 399/312 |

FOREIGN PATENT DOCUMENTS

| | | | | |
|---|---|---|---|---|
| JP | 03-062370 | U | | 6/1991 |
| JP | 5-119636 | | | 5/1993 |
| JP | 06-035326 | A | | 2/1994 |
| JP | 8-15996 | | | 1/1996 |
| JP | 9-015987 | | | 1/1997 |
| JP | 09015988 | A | * | 1/1997 |
| JP | 2001-92272 | | | 4/2001 |
| JP | 2002-148959 | | | 5/2002 |
| JP | 2005-10434 | | | 1/2005 |
| JP | 2009-145391 | A | | 7/2009 |

* cited by examiner

*Primary Examiner* — Quana M Grainger
(74) *Attorney, Agent, or Firm* — Canon USA Inc IP Division

(57) ABSTRACT

An image forming apparatus includes an image carrier configured to carry a toner image, a movable belt member configured to convey a recording material, a transfer member configured to electrostatically transfer the toner image formed on the image carrier to the recording material conveyed by the belt material, and a plurality of auxiliary separation members configured to separate the recording material from the belt member such that the belt member positioned more downstream than the transfer member in the direction in which the recording material is conveyed is boosted from the inside of the belt member to locally protrude the belt surface of the belt member in the width direction, wherein the auxiliary separation members can move correspondingly to the size of the conveyed recording material in the width direction to the position where the ends of the recording material pass in the width direction.

6 Claims, 9 Drawing Sheets

ELECTROPHOTOGRAPHIC IMAGE FORMING APPARATUS

BACKGROUND OF THE INVENTION

1. Field of the Invention

The present invention relates to an image forming apparatus which transfers a toner image carried by an image carrier to a recording material using an electrophotographic technique for a copying machine or a laser printer and, in particular, to an image forming apparatus including a transfer belt which performs the transfer to a recording material and the conveyance thereof.

2. Description of the Related Art

In an electrophotographic apparatus in which a recording material is carried and conveyed by a transfer belt stretched by a plurality of rollers, the recording material on the transfer belt passes a transfer nip portion and is electrostatically sucked on the transfer belt.

If the stiffness of the recording material is weak, the recording material cannot be separated from the transfer belt by merely using the curvature of a separation roller stretching the transfer belt and the stiffness of the recording material. In other words, the recording material is kept stuck to the transfer belt at the position of the separation roller to cause a separation defect. Japanese Patent Application Laid-Open No. 09-015987 discusses a method for separating the recording material such that protrusions are uniformly formed on the separation roller stretching the transfer belt to provide a corrugation for the transfer belt at a separation position. The use of such a configuration allows the corrugation to be formed on the transfer belt at the separation position, however, the transfer belt is always caused to exert great tension locally. This causes local wear on the transfer belt, thereby irregularity in resistance affects transferability.

Japanese Patent Application Laid-Open No. 05-119636 discusses a method for decreasing wear due to deformation while deforming the sheet carrying the recording material to separate the recording material. Japanese Patent Application Laid-Open No. 05-119636 also discusses a configuration in which a roller is provided as a boosting unit which can move to positions where the transfer sheet is boosted from the inside and not boosted. In the method discussed in Japanese Patent Application Laid-Open No. 05-119636, the roller boosts the transfer sheet to separate the recording material. The transfer sheet is not boosted while the recording material is not separated.

SUMMARY OF THE INVENTION

An aspect of the present invention is directed to an image forming apparatus in which the corrugation can be formed at the ends of the recording material in the width direction if the number of types of size of the recording material is increased even though the number of rollers to be arranged in the width direction is small.

According to an aspect of the present invention, an image forming apparatus includes an image carrier configured to carry a toner image, a movable belt member configured to convey a recording material, a transfer member configured to electrostatically transfer the toner image formed on the image carrier to the recording material conveyed by the belt material, and a plurality of auxiliary separation members configured to separate the recording material from the belt member such that the belt member positioned more downstream than the transfer member in the direction in which the recording material is conveyed is boosted from the inside of the belt member to locally protrude the belt surface of the belt member in the width direction, wherein the auxiliary separation members can move correspondingly to the size of the conveyed recording material in the width direction to the position where the ends of the recording material pass in the width direction.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DESCRIPTION OF THE EMBODIMENTS

Various exemplary embodiments, features, and aspects of the invention will be described in detail below with reference to the drawings.

Figure 1A:
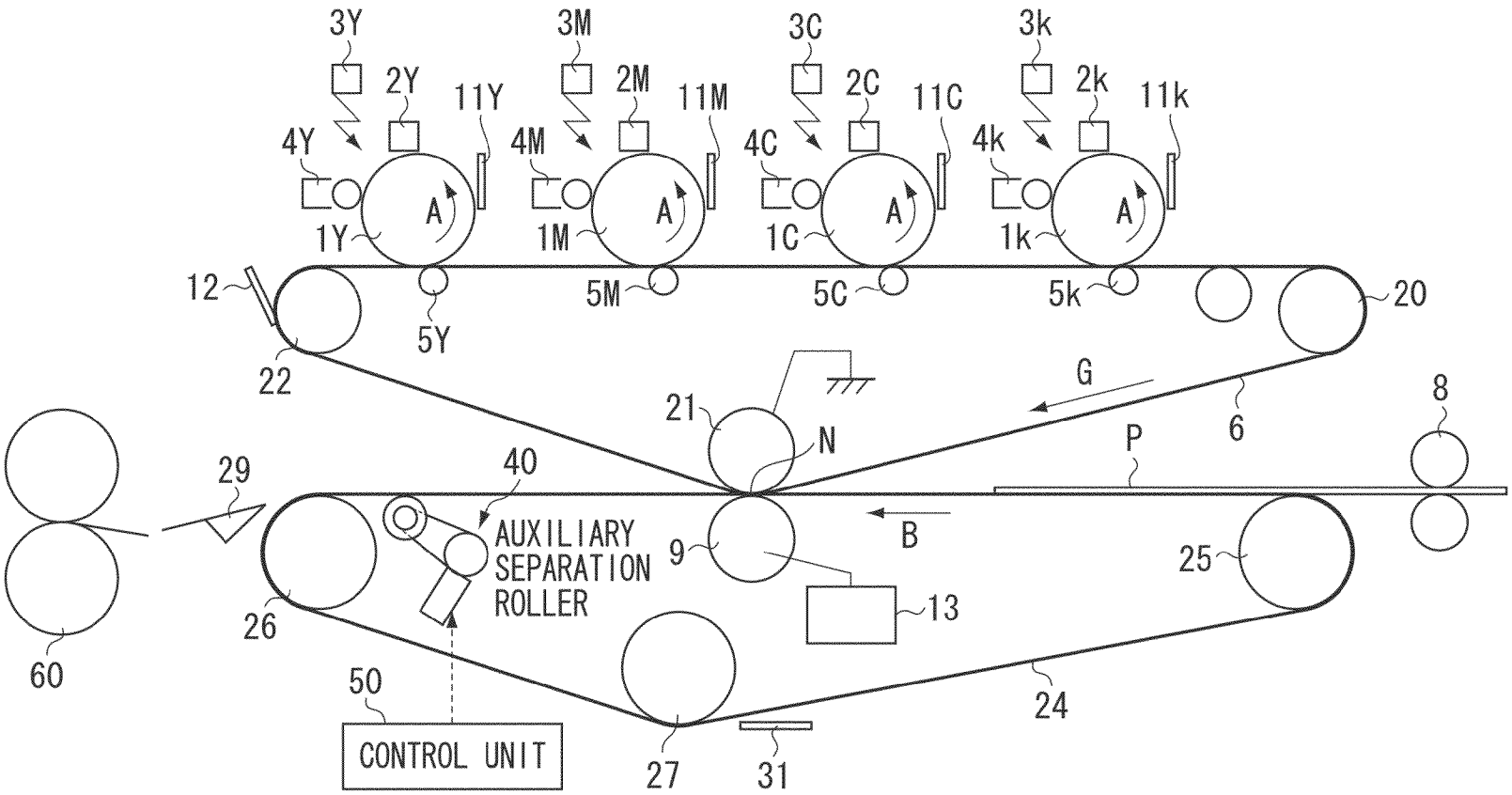
FIGS. 1A and 1B are schematic diagrams illustrating an image forming apparatus.

An image forming apparatus is described. The configuration and operation of the image forming apparatus according to the present exemplary embodiment are described below with reference to FIG. 1A.

Photosensitive drums 1Y, 1M, 1C, and 1*k* as image carriers are rotatably driven in the direction indicated by an arrow A. The surfaces thereof are uniformly charged to a predetermined voltage by charging devices 2Y, 2M, 2C, and 2*k*. The charged surfaces of the photosensitive drums are exposed by exposure devices 3Y, 3M, 3C, and 3*k* each comprised of a laser beam scanner to form an electrostatic latent image. The output of the laser beam scanner is turned on and off based on image information to form the electrostatic latent image corresponding to an image on each photosensitive drum. Development devices 4Y, 4M, 4C, and 4*k* include yellow (Y), magenta (M), cyan (C), and black (k) chromatic color toners respectively. A predetermined voltage is applied to the development devices. The electrostatic latent images are developed when passing the development devices 4Y, 4M, 4C, and 4*k* and toner images are formed on the photosensitive drums 1Y, 1M, 1C, and 1*k*. The present exemplary embodiment uses a reversal developing method for performing development with toner adhering to the exposure portion of an electrostatic latent image.

The toner images formed on the photosensitive drums 1Y, 1M, 1C, and 1*k* are primary-transferred to an intermediate transfer belt 6 by primary transfer rollers 5Y, 5M, 5C, and 5*k* to which their respective toner images correspond. Thus, four colored toner images are transferred to the intermediate transfer belt 6 in a superimposed manner.

The intermediate transfer belt 6 is provided to abut on the surface of a photosensitive drum 1, stretched by stretching rollers 20, 21, and 22 as a plurality of stretching members, and rotated in the direction indicated by an arrow G at 250 mm/sec to 300 mm/sec. In the present exemplary embodiment, the stretching roller 20 is a tension roller which controls to keep the tension of the intermediate transfer belt 6 constant. The stretching roller 22 is a drive roller for the intermediate transfer belt 6.

A transfer belt 24 carrying and conveying the recording material is a belt member which is stretched by stretching rollers 25, 26, and 27 as a plurality of stretching members and can move in the direction indicated by an arrow B at 250 mm/sec to 300 mm/sec. The transfer belt 24 uses a material in which an appropriate amount of carbon black as an antistatic agent is included in resin such as polyimide and polycarbonate and various rubbers. The volume specific resistance thereof is 1E+9 (Ω·cm) to 1E+14 (Ω·cm) and the thickness thereof is 0.07 mm to 0.1 mm. An elastic member is used as the transfer belt 24. Young's modulus measured according to a tensile test method (JIS K 6301) of the elastic member is 0.5 MPa or more and 10 MPa or less.

The use of a member whose Young's modulus in a tensile test for the transfer belt 24 is 0.5 MPa or more allows the belt to be rotated with the shape of the belt kept well enough. On the other hand, the use of a member whose Young's modulus is 10 MPa or less and which is flexible enough to be elastically deformed allows an auxiliary separation device 40 described later to effectively generate corrugation on the recording material P, achieving the effective separation of the recording material P from the transfer belt 24. The member flexible enough to be elastically deformed is liable to cause a relaxation phenomenon when the member reduces a deformation volume from a deformation state, so that the wear of the transfer belt 24 due to the auxiliary separation device 40 can be reduced.

The recording material P is stored in a cassette (not illustrated). When a supply start signal is output, the recording material P is conveyed from the cassette by a roller (not illustrated) based on the supply start signal and conducted to a registration roller 8. The registration roller 8 temporarily stops the recording material P and supplies the recording material P to the transfer belt 24 in synchronization with the toner image on the intermediate transfer belt 6 being conveyed.

A secondary transfer roller 9 opposing an intermediate transfer belt stretching roller 21 is arranged on the downstream side of the registration roller 8 in the direction in which the recording material P is conveyed (in the direction indicated by the arrow B) as a transfer member configured to form a transfer nip N for transferring the toner image to the recording material P carried by the transfer belt 24. When the recording material P is conveyed to the transfer nip N, a secondary transfer voltage whose polarity is opposite to that of the toner is applied to the secondary transfer roller 9 to electrostatically transfer the toner image on the intermediate transfer belt 6 to the recording material P in a collective manner. The secondary transfer voltage is controlled by constant voltage. The constant voltage value is determined according to current required for transfer. The current required for transfer varies from 30 A to 60 A because a secondary transfer current is changed by factors such as dry state of the recording material P, environment, and the amount of toner to be transferred.

The secondary transfer roller 9 is made up of an elastic layer of ion conductive foam rubber (acrylonitrile butadiene rubber (NBR)) and a core. The outer diameter thereof is 24 mm, roller surface roughness Rz is 6.0 μm to 12.0 μm, and resistance is 1E+5Ω to 1E+7Ω at a measurement of normal temperature/normal humidity (N/N) (23° C., 50% RH) and at an application of 2 kV. A secondary transfer high voltage power supply 13 with a variable supply bias is connected to the secondary transfer roller 9.

After transfer is performed, the recording material P separated from the transfer belt 24 is conveyed to a fixing device 60 via the guiding surface of a recording material guide 29 and a toner image is fixed to the recording material P in a heating and pressing process. After the toner image is fixed, the recording material P is discharged outside the apparatus.

Figure 1B:
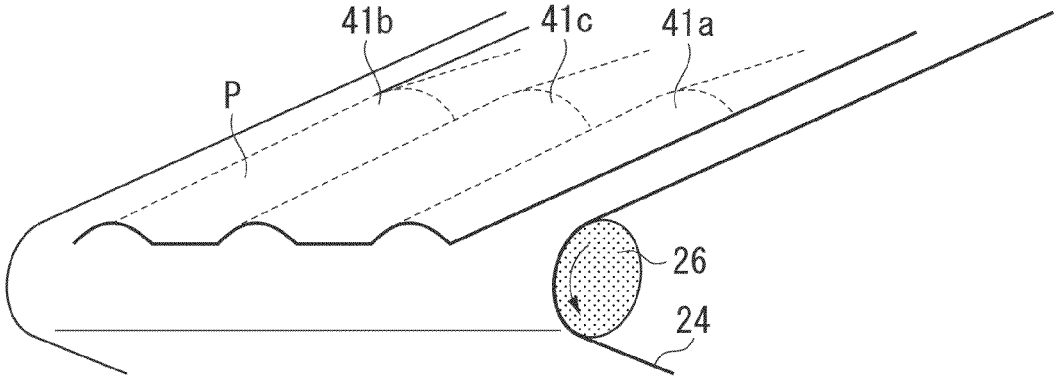

The configuration of the auxiliary separation device 40 is described below. In the present exemplary embodiment, the auxiliary separation device 40 in which the transfer belt 24 is locally boosted and deformed in the width direction to separate the recording material P from the transfer belt 24 is provided as a boosting unit which boosts the transfer belt 24 to help the recording material P to be separated from the transfer belt 24. FIG. 1B illustrates that the transfer belt 24 is locally boosted in the width direction using the auxiliary separation device 40. The auxiliary separation device 40 is provided more downstream than the secondary transfer roller in the direction in which the recording material is conveyed and inside the transfer belt 24.

Figure 2A:
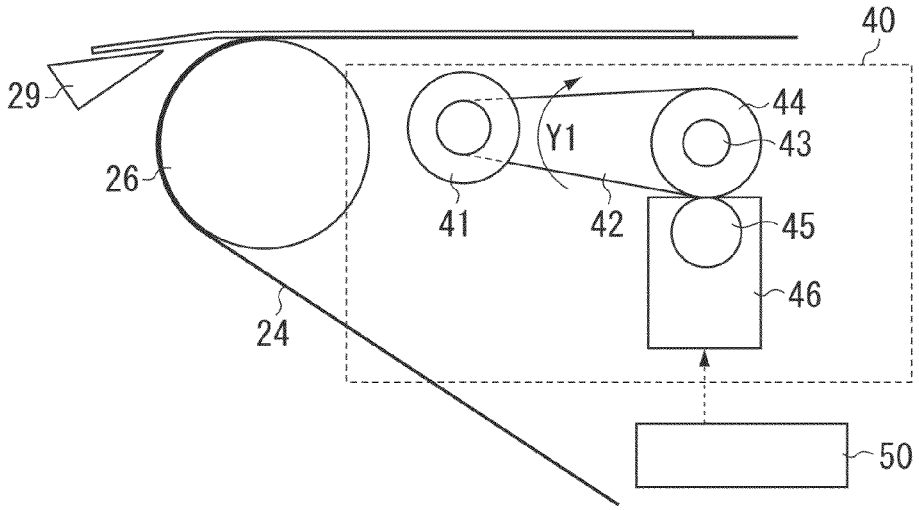
FIGS. 2A to 2C are schematic diagrams illustrating an auxiliary separation device.
Figure 2B:
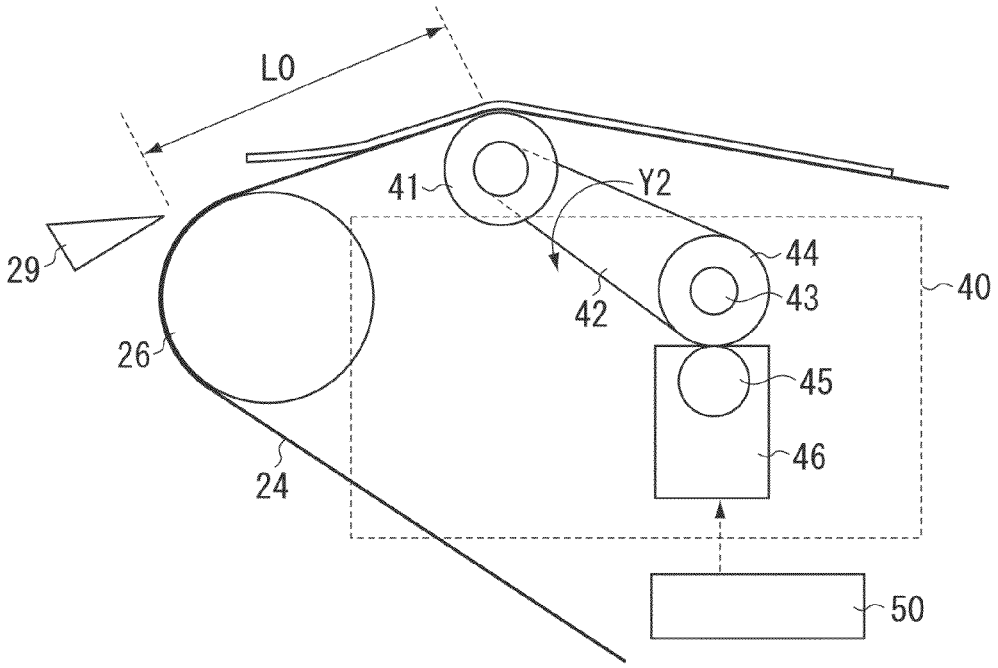

FIGS. 2A and 2B illustrate the detail configuration and operation of the auxiliary separation device 40. The auxiliary separation device 40 includes an auxiliary separation roller 41 being an auxiliary separation member, a roller frame 42 for rotatably supporting the auxiliary separation roller 41, and a roller swing central axis 43 being the center of swing of the auxiliary separation roller 41. The auxiliary separation device 40 further includes a roller drive gear 44 for swing the auxiliary separation roller 41 with the roller swing central axis 43 as a center, a motor drive transmission gear 45 for transmitting a drive force to the roller drive gear 44, and a motor 46 being a drive source. The rotational movement of the motor 46 is transmitted to the roller drive gear 44 by the motor drive transmission gear 45. A bearing is provided between the roller drive gear 44 and the roller swing central axis 43, so that the roller swing central axis 43 is not affected by the rotational movement of the motor 46, so that the position thereof is not moved.

FIG. 2A illustrates a storage position where the auxiliary separation roller 41 as the auxiliary separation member is stored with the auxiliary separation roller 41 separated from the transfer belt 24. FIG. 2B illustrates a boost position where the auxiliary separation roller 41 abuts on the inner surface of the transfer belt 24 to locally boost the transfer belt 24. The auxiliary separation roller 41 and the roller frame 42 move from the roller storage position to the boost position in the direction Y1 by a predetermined amount of normal rotation of the motor 46 with the roller swing central axis 43 as a center. Furthermore, the auxiliary separation roller 41 and the roller frame 42 can move from the boost position to the storage position in the direction Y2 by a predetermined amount of reverse rotation of the motor 46. In other words, the normal and the reverse rotation cause the auxiliary separation roller 41 to perform such a swing operation.

The auxiliary separation roller 41 is made of ethylene propylene rubber (EPDM). The outer diameter thereof is 8 mm and the width is 10 mm. It is needless to say that the outer diameter and the width are not limited to those values. The outer diameter may preferably be in the range from 6 mm to 10 mm. The width may preferably be in the range from 5 mm to 15 mm. The auxiliary separation roller 41 boosts the transfer belt 24 to form a local protrusion on the transfer belt 24 in the width direction. The width direction refers to a direction orthogonal to the direction in which the belt surface moves.

In FIG. 2A, the distance between the auxiliary separation roller 41 and the stretching roller 26 is 4 mm to 8 mm. In FIG. 2B, the auxiliary separation roller 41 boosts the belt surface of the transfer belt 24 by 3 mm to 6 mm from the inside and from a planer state in FIG. 2A.

An electric charge whose polarity is opposite to that of the toner is applied to the inner surface of the transfer belt 24 by the secondary transfer roller 9, so that the recording material P is attracted by the transfer belt 24 at the transfer nip N and on the downstream side thereof. A recording material being weak in stiffness such as thin paper is liable to be deformed. For this reason, corrugation is produced on the recording material along local protrusions produced by boost on the transfer belt 24 in the width direction. As a result, the second moment of area of the recording material P, i.e., the stiffness thereof is increased. This provides separation effect effective to separate the recording material being weak in stiffness such as thin paper.

The conveyance of the separated recording material P is supported by the stiffness being increased by the corrugation of the recording material P. The corrugation is formed on the recording material P in a protrusion formation position where the protrusions are formed on the transfer belt 24. When the trailing edge of the recording material P passes the protrusion formation position, the corrugation of the recording material P collapses. A too long distance between the protrusion formation position and the recording material guide 29 may cause a problem in that the trailing edge of the recording material P passes the protrusion formation position on the transfer belt 24 before the leading edge of the recording material P reaches the upstream end of the guide surface of the recording material guide 29 in the direction in which the recording material P is conveyed. Therefore, it is desirable to perform setting so that the distance between the protrusion formation position and the upstream end of the guide surface of the recording material guide 29 in the direction in which the recording material P is conveyed is shorter than the minimum size of a recording material used for image forming apparatus in the conveyance direction. The protrusion formation position refers to a central position in the conveyance direction in the range where the transfer belt 24 comes into contact with the auxiliary separation roller 41 when the transfer belt 24 is boosted by the auxiliary separation roller 41. The distance between the upstream end of the guide surface of the recording material guide 29 in the direction in which the recording material P is conveyed and the protrusion formation position is shown by L0 in FIGS. 2A to 2C.

In the present exemplary embodiment, the auxiliary separation device 40 includes a plurality of the auxiliary separation rollers 41. In a case where a plurality of the auxiliary separation rollers 41 is arranged, a too narrow arrangement interval among the auxiliary separation rollers 41 totally boosts the transfer belt 24 not to form a plurality of local protrusions on the transfer belt 24 in the belt width direction, which cannot increase separability. Accordingly, interval needs to be increased to form a plurality of local protrusions in the belt width direction.

Figure 3:
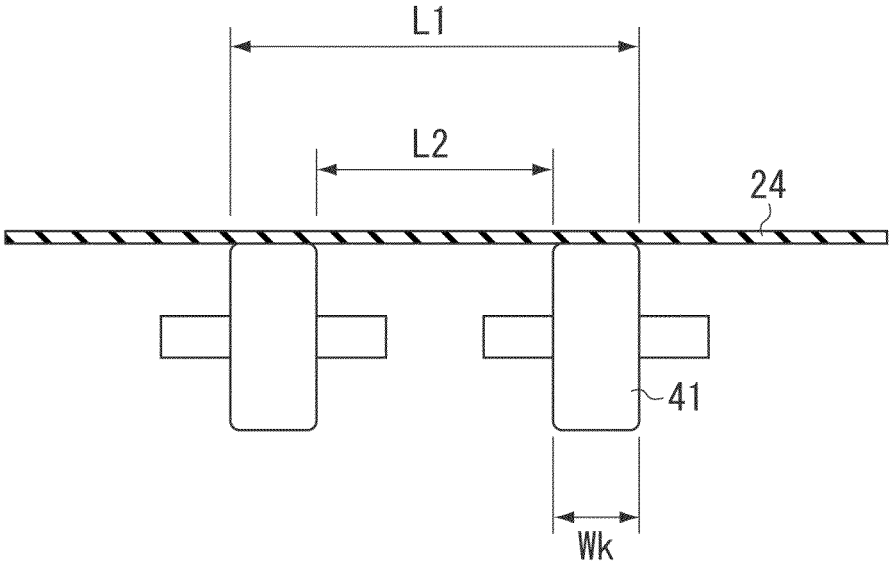
FIG. 3 is a schematic diagram illustrating the auxiliary separation device.

In the present exemplary embodiment, the width of the auxiliary separation roller 41 and the space therebetween are set with respect to the direction orthogonal to the running direction of the transfer belt 24 as illustrated in FIG. 3. L1 indicates the length of a portion surrounded by the auxiliary separation rollers 41 and Wk indicates the width of the auxiliary separation roller 41. L2 signifies a portion in the end surfaces, opposing each other, of the two adjacent auxiliary separation rollers 41 and can be determined by L1−2 Wk. In the present exemplary embodiment, L2 is set to 2 Wk or more. More specifically, the length for which the auxiliary separation roller 41 does not come into contact with the transfer belt 24 is longer than the length for which the auxiliary separation roller 41 comes into contact with the transfer belt 24. As a result, the transfer belt 24 is locally protruded in a plurality of positions in the belt width direction instead of being boosted overall to easily produce irregularities on the transfer belt 24.

Figure 2C:
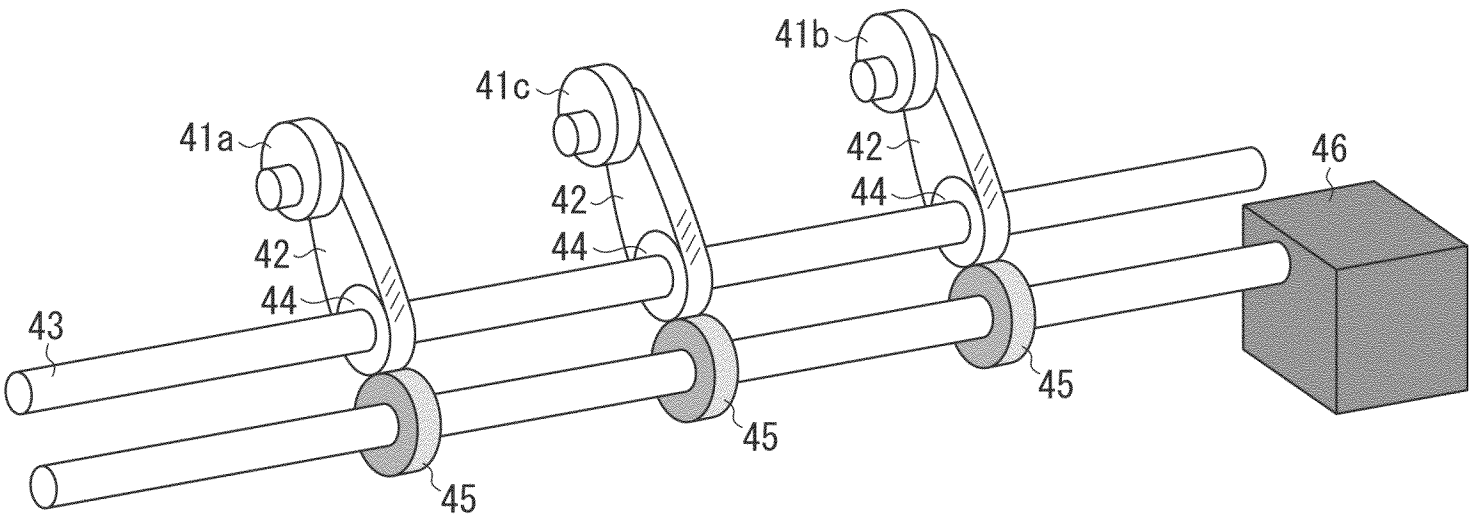

FIG. 2C illustrates a perspective view of the auxiliary separation device 40 in the present exemplary embodiment. In the present exemplary embodiment, as illustrated in FIG. 2C, three auxiliary separation rollers 41*a*, 41*b*, and 41*c* are arranged in the width direction. The auxiliary separation roller 41*c* is arranged at the center thereof.

Figure 4:
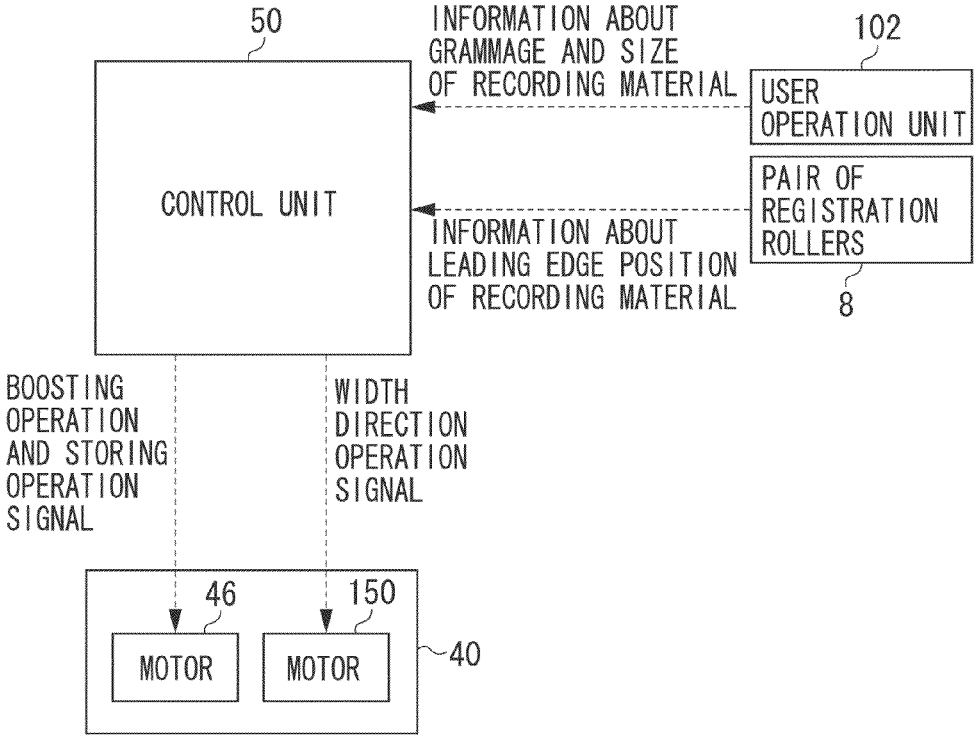
FIG. 4 is a schematic diagram illustrating the auxiliary separation device.

The boosting control of the auxiliary separation device 40 is described below. The boosting and the storing operation of the auxiliary separation device 40 are controlled by the control unit 50. The operation in the width direction is also controlled by the control unit 50 as described in detail later. FIG. 4 illustrates the relationship of the above control. The control of boosting and storing operation signals and the operation signal in the width direction of the auxiliary separation device 40 is based on information about grammage and size of the recording material P designated by the user, and information about the position of leading edge of the recording material acquired based on the reading material feed timing of the pair of registration rollers 8 and the conveyance speed of the recording material. The control unit includes a central processing unit (CPU), a read only memory (ROM), and a random access memory (RAM). Information from the operation unit 102 through which the user operates the image forming unit is input to the control unit 50. The operation timing of the registration roller 8 is input to the control unit 50. The control unit 50 controls the operation of the motor 46 being a drive source for the swing operation of the auxiliary separation roller 41 and a motor 150 being a drive source for operation in the width direction in the auxiliary separation device 40. Operation in the width direction is described in detail later.

Grammage is a unit of weight per unit area ($g/m^2$) and is generally used as a value indicating the thickness of a recording material.

In the present exemplary embodiment, the following two types of patterns are stored in the ROM.

1) In a case where the grammage of a recording material is 40 $g/m^2$ or less, the auxiliary separation roller 41 is positioned in the boost position to locally protrude the transfer belt 24 in the width direction.
2) In a case where the grammage of a recording material is greater than 40 $g/m^2$, the auxiliary separation roller 41 is positioned in the storage position. The auxiliary separation roller 41 is separated from the transfer belt 24 in the storage position.

In other words, the recording material with a specific grammage (a first grammage) is subjected to an operation for boosting the auxiliary separation roller 41. A second recording material which is greater in grammage than the first recording material is not subjected to the operation for boosting the auxiliary separation roller 41. The above reason is described below. The recording material such as thin paper being weak in stiffness can be separated such that the transfer belt is boosted using the auxiliary separation roller 41 to increase the stiffness of the recording material. Although a thick recording material can also be separated by boosting the transfer belt 24 by the auxiliary separation roller 41, the boost of the transfer belt 24 subjects the transfer belt 24 to a non-negligible local load to accelerate a local wear of the transfer belt 24. It has been known that a thick recording material can be separated by using the curvature of a stretching member. Then, the thick recording material is separated by using the curvature of the stretching member on the downstream side of the auxiliary separation roller 41 in the direction in which the recording material is conveyed to suppress the local wear of the transfer belt 24.

In the present exemplary embodiment, the storage position is set to a position where the auxiliary separation roller 41 is separated from the transfer belt 24 to avoid wear of the transfer belt 24. In the present exemplary embodiment, although the auxiliary separation roller 41 is separated from the transfer belt 24 in the storage position, the auxiliary separation roller 41 may slightly comes into contact with the transfer belt 24 to the extent that the auxiliary separation roller 41 does not deform the transfer belt 24.

The grammage of the recording material is input by the user via the operation unit 102 or input to a storage unit for storing the recording material. The control unit 50 determines the operation of the auxiliary separation device 40 based on information about the grammage input to image forming apparatus by the above manner.

In the present exemplary embodiment, the cassette specified according to information about the grammage input by the user is used. However, in a case where the recording material being small in grammage is incorrectly stored in the cassette for the recording material being great in grammage, the control unit regards the cassette as that for the recording material great in grammage and determines the operation of the auxiliary separation device 40, so that the boost operation is not performed. This may lead to a separation defect. For this reason, a sensor may be provided for the image forming apparatus to determine the grammage of the recording material. When the operation of the auxiliary separation device 40 is controlled based on the grammage determined by the sensor, the boost operation is performed even if the recording material being small in grammage is incorrectly stored in the cassette for the recording material being great in grammage. In other words, even if the recording material being small in grammage is stored incorrectly, the recording material being small in grammage can be prevented from separation defective. A weight sensor for detecting the weight of the recording material to be conveyed may be provided as the sensor on the conveyance path for the recording material to determine the grammage of the recording material based on the weight detected by the weight sensor and information about the size (area) of the recording material. Alternatively, a transmission sensor for detecting light transmissivity may be provided on the conveyance path for the recording material to determine the thickness of the recording material from the transmissivity of the conveyed recording material which transmits light.

Figure 7A:
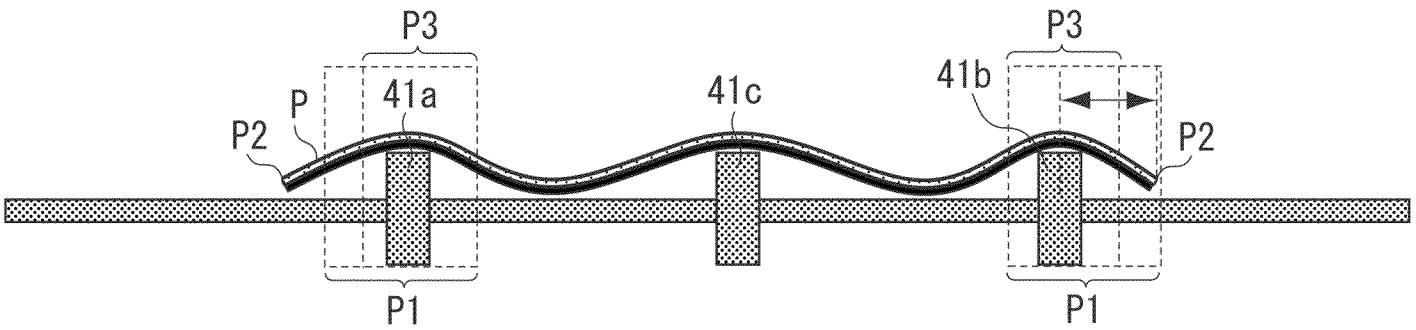
FIGS. 7A and 7B are schematic diagrams illustrating the corrugation of a recording material.

The auxiliary separation roller which is movable in the width direction is described below. As described above, in the present exemplary embodiment, the transfer belt is boosted to provide a corrugation for the recording material, increasing the stiffness of the recording material in separating the recording material such as thin paper weak in stiffness. If the corrugation is not formed at the ends of the recording material in the width direction, the ends of the recording material hang down to lead to the occurrence of a conveyance defect. It is therefore desirable to adopt a configuration in which the ends of the recording material in the width direction are boosted by the auxiliary separation roller of the boosting unit to prevent the ends of the recording material from hanging down to lead to occurrence of a conveyance defect. The term "end of the recording material in the width direction" refers to a range P1 from an edge P2 of the recording material in the width direction to 40 mm inward from the edge P2. To prevent the end of a recording material with a specific size from hanging down, the auxiliary separation roller is desirably arranged at the position where the end of the recording material with the specific size passes (refer to FIG. 7A).

Figure 7B:
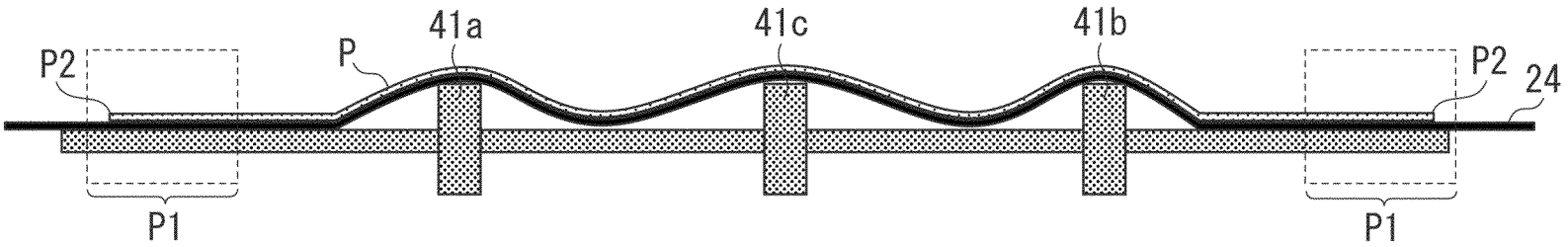

However, change in the size of the recording material also changes the position where the end of the recording material passes (refer to FIG. 7B). The roller fixed to the position where the end of the recording material with the specific size passes cannot boost the end of a recording material which is different in size. To boost the end of the recording material with various sizes, there may be a method for increasing the number of the auxiliary separation rollers so that the auxiliary separation roller is arranged at the position where the end of the recording material with various sizes passes. However, the number of the auxiliary separation rollers which can be arranged in the width direction may be limited from the viewpoint of space, so that the number of the auxiliary separation rollers may not be able to be increased according as the types of size of the recording material are increased. It is desirable that a corrugation can be formed at the ends of the recording material in the width direction if the types of size of the recording material are increased even though the number of the rollers to be arranged in the width direction is small. In the present exemplary embodiment, auxiliary separation rollers 41*a* and 41*c* movable in the width direction are arranged so that each auxiliary separation roller can form a corrugation at each end of the recording material with a plurality of sizes.

Figure 5:
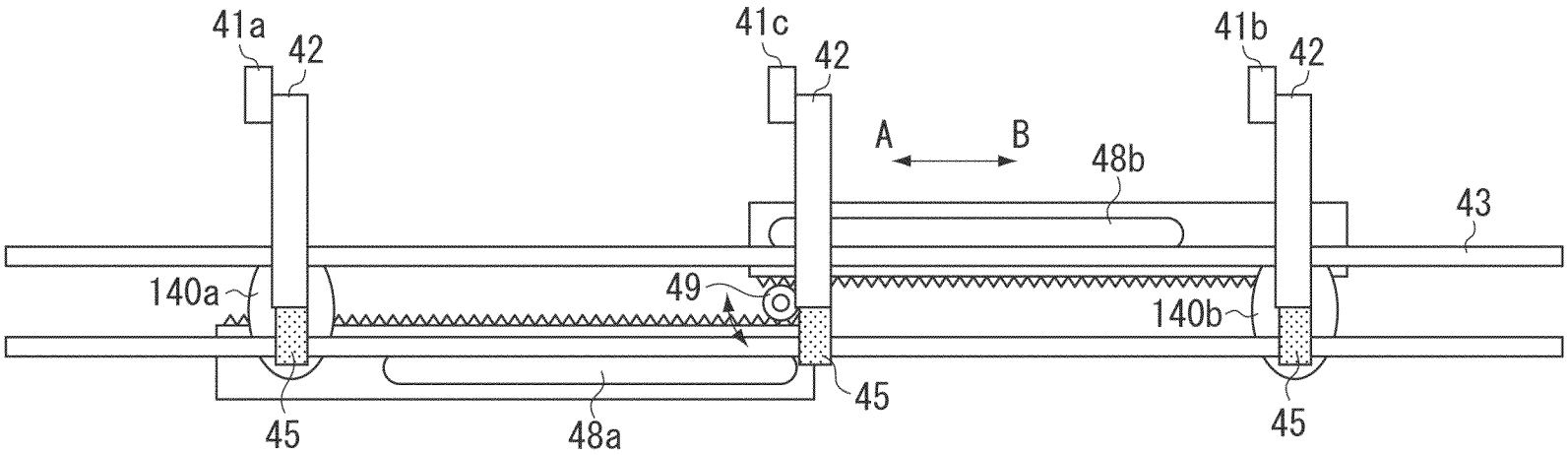
FIG. 5 is a schematic diagram illustrating the auxiliary separation device.

A configuration in which the auxiliary separation rollers 41*a* and 41*c* are moved in the width direction is described in detail below with reference to FIG. 5. The auxiliary separation device 40 being the configuration in which the auxiliary separation rollers 41*a* and 41*c* are moved in the width direction includes slide volume controls 48*a* and 48*b*, a gear 49, and pedestals 140*a* and 140*b*. The gear 49 is positioned at the center of the transfer belt in the width direction and transmits driving force from the motor 150. The slide volume controls 48*a* and 48*b* engaging with the gear 49. When the gear 49 is rotated, the slide volume 48*a* and 48*b* receive driving force from the motor 150 via the gear 49 to slidably move to the width direction.

The gear 49 is interposed between the slide volume 48*a* and 48*b* so that the slide volume 48*a* and 48*b* move in the directions opposite to each other. The pedestals 140*a* and 140*b* are fixed to the slide volume 48*a* and 48*b* respectively and sandwich the roller drive gears 44 of the auxiliary separation rollers 41*a* and 41*b* corresponding to the pedestals 140*a* and 140*b* respectively and the motor drive transmission gears 45 from both sides in the width direction. In other words, the auxiliary separation rollers 41*a* and 41*b* sandwiched by the pedestals can move in the width direction along with the slide movement of the slide volume controls 48*a* and 48*b* in the width direction.

Arrangement is performed such that the interval between the pedestal 140*a* and the central gear 49 in the width direction becomes equal to the interval between the pedestal 140*b* and the central gear 49 in the width direction. As a result, the auxiliary separation rollers 41*a* and 41*b* move symmetrically with respect to the central gear 49. The reason is described below. In the present exemplary embodiment, even if the recording material is different in size, the recording material is conveyed so that the center line of the recording material in the width direction substantially agrees with that of the transfer belt in the width direction. Thus, the position where one end of the recording material passes is symmetrical to the position where the other end thereof passes in the width direction with respect to the center line of the transfer belt in the width direction even if the recording material is different in size. In a configuration in which the recording material is conveyed so that the center line of the recording material agrees with that of the transfer belt, the auxiliary separation rollers 41*a* and 41*b* can be easily moved to the position where the ends of the recording material pass even if the recording material is different in size.

The auxiliary separation roller 41*c* positioned between the auxiliary separation rollers 41*a* and 41*b* is fixed to the center of the transfer belt 24 in the width direction and immovable in the width direction. The reason the position in the width direction is fixed to the center is that a corrugation is provided for the center of the recording material in the width direction. Since the recording material is conveyed so that the center line of the recording material agrees with that of the transfer belt even if the recording material is different in size, the corrugation can be provided for the center of the recording material in the width direction.

In the configuration of the present exemplary embodiment, the drive source for moving the auxiliary separation rollers 41*a* and 41*b* in the width direction is made common to the rollers, however, the configuration is not limited to the above. Drive sources for moving the auxiliary separation rollers 41*a* and 41*b* movable in the width direction may be independent of each other.

In the configuration of the present exemplary embodiment, the two auxiliary separation rollers movable in the width direction are provided to boost the both ends, however, the configuration is not limited to the above. An auxiliary separation roller movable in the width direction may be used to boost one end of the recording material in the width direction and an auxiliary separation roller immovable in the width direction may be used to boost the other end thereof. In the configuration of the present exemplary embodiment, the interval between the edge of the recording material in the width direction and the position where the auxiliary separation roller boosts the transfer belt is constant regardless of the size of the recording material, however, the configuration is not limited to the above. The interval between the edge of the recording material in the width direction and the position where the auxiliary separation roller boosts the transfer belt may be decreased according as the size of the recording material in the width direction is decreased.

The control of operation of the auxiliary separation device 40 in the width direction is described below. The amount of movement of the auxiliary separation device 40 in the width direction is previously set by the control unit 50. The control unit 50 controls the operation of the motor 150 being the drive source for moving the auxiliary separation rollers 41*a* and 41*b* in the width direction based on information about the size of the recording material specified by the user. The amount of movement in the width direction is determined so that the auxiliary separation roller 41*a* movable in the width direction is arranged at the position where one end of the recording material specified by the user can be boosted and the auxiliary separation roller 41*b* movable in the width direction is arranged at the position where the other end of the recording material can be boosted. In the present exemplary embodiment, the amount of movement in the width direction is set so that the center line of the auxiliary separation roller 41*a* in the width direction agrees with the position 25 mm inward from the position where the edge of the recording material in the width direction, whose size is specified by the user, passes, even if the recording material specified by the user is different in size. Such a setting allows the corrugation to be formed to the edge of the recording material in the width direction.

In the configuration of the present exemplary embodiment, setting is performed so that the center line of the auxiliary separation roller in the width direction agrees with the position 25 mm inward from the position where the edge P2 of the recording material in the width direction passes, however, the configuration is not limited to the above value. The center line of the auxiliary separation roller in the width direction may preferably be positioned in a range P3 10 mm to 40 mm inward from the position where the edge P2 of the recording material in the width direction passes. If the center line of the auxiliary separation roller in the width direction is positioned in the range P1 40 mm or less inward from the position where the edge P2 of the recording material passes, the distance between the position where the auxiliary separation roller boosts the transfer belt and the edge P2 of the recording material is short, so that the corrugation can be surely provided for the edge of the recording material in the width direction. The reason the center line of the auxiliary separation roller in the width direction is away by at least 10 mm from the position where the edge P2 of the recording material passes is that the position where the auxiliary separation roller boosts the transfer belt being too near to the edge P2 of the recording material may make it difficult to provide the corrugation for the recording material.

In the present exemplary embodiment, the auxiliary separation rollers 41*a* and 41*b* at the time of starting the formation of an image are set independent of information about the size of the recording material so that the center lines of the auxiliary separation rollers 41*a* and 41*b* in the width direction agree respectively with the position 25 mm inward from the position where the edges of an A-4 sized recording material in the width direction pass respectively. For that reason, in a case where the recording material specified by the user is A-4 size, a process can be transferred to the following image forming process without moving in the width direction. This increases productivity for the A-4 sized recording material supposed to be most frequently used.

On the other hand, in a case where the recording material specified by the user is not A-4 size, the distance between the position 25 mm inward from the edge of the A-4 sized recording material to the position 25 mm inward from the edge of size of the recording material, is set as the amount of movement of the auxiliary separation rollers 41*a* and 41*b*.

Figure 6:
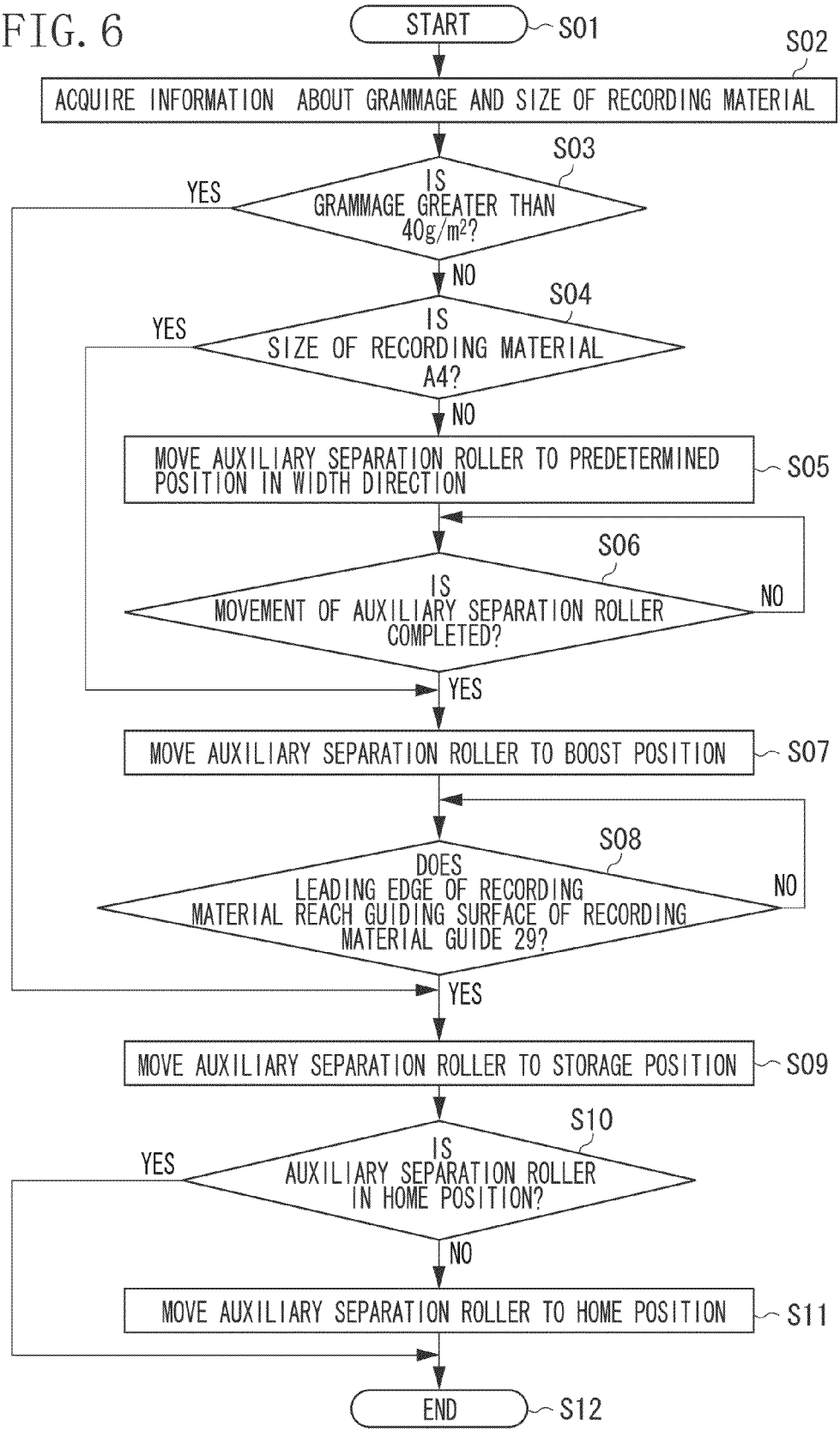
FIG. 6 is a schematic diagram illustrating the auxiliary separation device.

A flow chart for controlling the operation of the auxiliary separation device 40 is described below with reference to FIG. 6. In step S01, as illustrated in FIG. 6, an image formation signal is input to start operation. In step S02, the control unit 50 reads information about the grammage of the recording material used for image formation and information about the size of the recording material, in other words information set by the user via the user operation unit 102. In step S03, the control unit 50 determines whether the read grammage is greater than 40 g/m$^2$. If the control unit 50 determines that the grammage of the recording material is greater than 40 g/m$^2$ (YES in step S03), in step S09, the control unit 50 arranges the separation roller at the storage position.

A plain paper or a thick paper can be separated by the curvature of the stretching roller to suppress the wear of the transfer belt due to boosting at the time of separating a plain paper or a thick paper. If the grammage of the recording material is 40 g/m$^2$ or smaller (NO in step S03), the recording material is low in stiffness, so that the boost operation is required in which the auxiliary separation device 40 boosts the transfer belt to form protrusions to separate the recording material from the transfer belt 24. If the grammage of the recording material is 40 g/m$^2$ or smaller (NO in step S03), in step S04, the control unit 50 determines whether the recording material is A-4 size. If the control unit 50 determines that the recording material is A-4 size (YES in step S04), in step S07, the auxiliary separation rollers 41*a* and 41*b* do not move in the width direction but move to the boost position where the transfer belt 24 is boosted.

The reason is described below. The home position of the auxiliary separation rollers 41*a* and 41*b* in the width direction at the time of starting the formation of an image is set at the position corresponding to the position where the ends of the A-4 sized recording material in the width direction pass. For that reason, there is no need for moving the auxiliary separation rollers 41*a* and 41*b* in the width direction to form the corrugation at the ends of the A-4 sized recording material. On the other hand, if the recording material is not A-4 size, an operation is required for moving the auxiliary separation rollers 41*a* and 41*b* to form the corrugation at the ends of the recording material in the width direction. If the control unit 50 determines that the recording material is not A-4 size (NO in step S04), the auxiliary separation rollers 41*a* and 41*b* move in the width direction. The amount of movement in the width direction based on the size of the recording material specified by the user is previously set in the control unit 50.

The motor 150 being the drive source for the slide volume 48*a* and 48*b* drives according to the amount of rotation corresponding to the amount of movement so that the auxiliary separation rollers 41*a* and 41*b* are arranged at the position where the ends of the recording material of the size of the recording material specified by the user pass. In step S06, the control unit 50 determines whether the movement of the auxiliary separation rollers 41*a* and 41*b* is completed. In step S07 after step 06, the auxiliary separation rollers 41*a*, 41*b*, and 41*c* move to the boost position. The reason is described below. The reason is that when the auxiliary separation rollers 41*a* and 41*b* is boosted before the auxiliary separation rollers 41*a* and 41*b* finish moving in the width direction, the auxiliary separation rollers 41*a* and 41*b* move in the width direction while the rear surface of the transfer belt 24 is subjected to load, causing the auxiliary separation rollers 41*a* and 41*b* to slide on the other surface of the transfer belt. When the auxiliary separation rollers 41*a* and 41*b* move to the boost position, the recording material P is provided with the corrugation on the transfer belt deformed by the auxiliary separation rollers 41*a* and 41*b* and the recording material P increases in stiffness, thereby the recording material P is separated from the transfer belt before reaching the stretching roller 26.

In step S08, the control unit 50 determines whether the leading edge of the recording material reaches the recording material guide 29. In a case where a plurality of the recording materials continuously passes, the storage operation preferably may start after the position of leading edge of the last recording material is detected in step S08. In the present exemplary embodiment, the recording material guide 29 is provided with a recording material detecting sensor (not illustrated). The recording material detecting sensor determines whether the leading edge of the recording material reaches the recording material guide 29. It is needless to say that other methods may be used, such as, for example, a method for detecting the position of the recording material by performing counting from a predetermined point without the recording material guide 29 being provided with a recording material detecting sensor. If the recording material reaches the recording material guide 29 (YES in step S08), in step S09, the control unit 50 determines that separation is performed and moves the separation rollers to the storage position.

If recording material detecting sensor does not detect the recording material, the control unit 50 determines that the recording material does not reach the recording material guide 29 (NO in step S08) and keeps the boost of the separation rollers. In step S10, the control unit 50 determines whether the position of the auxiliary separation rollers 41*a* and 41*b* in the width direction indicates the home position. If the control unit 50 determines that the position of the auxiliary separation rollers 41*a* and 41*b* in the width direction indicates the home position (YES in step S10), in step S12, the processing is ended. If the control unit 50 determines that the position of the auxiliary separation rollers 41*a* and 41*b* does not indicate the home position (NO in step S10), in step S11, the auxiliary separation rollers 41*a* and 41*b* move to the home position and the processing is ended. The reason the auxiliary separation rollers 41*a* and 41*b* move again to the home position is that preparations are taken for the case where the user specifies the A-4 sized recording material supposed to be frequently used.

The exemplary embodiment of the present invention is described above. The present invention is not limited to the exemplary embodiment and various modifications can be made in the technical concept of the present invention.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2010-234229 filed Oct. 19, 2010, which is hereby incorporated by reference herein in its entirety.

What is claimed is:

1. An image forming apparatus comprising:

an image carrier configured to carry a toner image;

a movable belt member configured to convey a recording material;

a transfer member configured to electrostatically transfer the toner image formed on the image carrier to the recording material conveyed by the belt member;

a boost unit having a plurality of protrusions in a width direction of the belt member orthogonal to a conveying direction of the belt member and configured to push the belt member from an inner side of the belt member downstream of the transfer member in a conveying direction of the recording material so that the plurality of protrusions form a plurality of protruded portions on the belt member in a thickness direction of the belt member; and a control portion configured to set a smaller interval between adjacent protrusions in the width direction when the belt member conveys a recording material of a first size in the width direction than an interval between the adjacent protrusions in the width direction when the belt member conveys a recording material of a second size larger than the first size.

2. The image forming apparatus according to claim 1, further comprising:

a first moving mechanism configured to move end protrusions in the width direction arranged at both ends in the width direction among the plurality of protrusions; and a second moving mechanism configured to reciprocally move the protrusions between a boosted position where the belt member is pushed and a retracted position where the protrusions are away from the belt member, wherein the control portion is configured to cause the first moving mechanism to move the end protrusions in the width direction when the protrusions are at the retracted position.

3. The image forming apparatus according to claim 2, wherein the first moving mechanism is configured to reciprocally move the end protrusions between end positions near positions where ends of the recording material being conveyed in the width direction pass and reference positions inside positions where ends of a recording material of a maximum passable size in the width direction pass, and the control portion is configured to cause the first moving mechanism to move the end protrusions from the reference positions to the end positions and subsequently cause the second moving mechanism to move the protrusions from the retracted position to the boosted position when the control portion starts to push the protrusions, and cause the second moving mechanism to move the protrusions from the boosted position to the retracted position and subsequently cause the first moving mechanism to move the end protrusions from the end positions to the reference positions when the control portion starts to retract the protrusions.

4. The image forming apparatus according to claim 3, wherein the edge position is provided to a range from 10 mm inward from the edge of the recording material to 40 mm inward from the edge in the width direction.

5. The image forming apparatus according to claim 3, wherein an edge position is provided in a range from the edge of the recording material to 40 mm inward from the edge in the width direction.

6. The image forming apparatus according to claim 3, wherein the reference positions correspond to positions where ends of a recording material that is most frequently used in the width direction pass.

* * * * *